US007320195B1

(12) United States Patent
Kushner

(10) Patent No.: US 7,320,195 B1
(45) Date of Patent: Jan. 22, 2008

(54) SELF SUPPORTING KNOCK-DOWN DISPLAY FRAME DEVICE HAVING A MULTITUDE OF INTERCHANGEABLE PARTS ENGAGED BY AN INTEGRAL FRAME FASTENING AND FRAME SUPPORT DEVICE

(76) Inventor: Roy Kushner, 221 E. 23rd St., Apartment 20, New York, NY (US) 10010

( * ) Notice: Subject to any disclaimer, the term of this patent is extended or adjusted under 35 U.S.C. 154(b) by 57 days.

(21) Appl. No.: 11/134,941

(22) Filed: May 23, 2005

(51) Int. Cl.
*A47G 1/06* (2006.01)
*A47G 1/16* (2006.01)

(52) U.S. Cl. ..... 40/781; 40/761; 40/780

(58) Field of Classification Search ..... 40/729, 40/777, 780, 745, 761, 768, 781; 52/663; 229/92.8; 428/79, 542.2, 913.3
See application file for complete search history.

(56) References Cited

U.S. PATENT DOCUMENTS

| | | | | | |
|---|---|---|---|---|---|
| 369,407 | A | * | 9/1887 | Meeker | 40/777 |
| 377,231 | A | * | 1/1888 | Boreham | 40/780 |
| 560,465 | A | | 5/1896 | Bostwick | |
| 1,851,917 | A | * | 3/1932 | Maggio | 40/799 |
| 1,998,640 | A | * | 4/1935 | Shaw | 40/778 |
| 2,089,765 | A | * | 8/1937 | Shaw | 40/746 |
| 2,178,727 | A | * | 11/1939 | Owens | 411/143 |
| 2,409,814 | A | | 10/1946 | Vargish | |
| 2,486,174 | A | | 10/1949 | Kissling | |
| 2,591,565 | A | | 4/1952 | Linnard | |
| 2,828,565 | A | | 4/1958 | Goldstein | |
| 2,832,176 | A | | 4/1958 | Vergeer | |
| 3,973,343 | A | | 8/1976 | Tolfsen | |
| 4,091,555 | A | | 5/1978 | Korzon | |
| 4,283,869 | A | * | 8/1981 | Rappa | 40/661 |
| 4,310,976 | A | | 1/1982 | Wilton | |
| 4,704,814 | A | | 11/1987 | Astolfi | |
| 4,776,117 | A | | 10/1988 | Astolfi | |
| D308,449 | S | | 6/1990 | Canetti | |
| D335,394 | S | | 5/1993 | Chamlian | |
| D339,238 | S | | 9/1993 | Hamilton | |
| 5,343,642 | A | | 9/1994 | Magnusson | |
| 5,502,907 | A | * | 4/1996 | Wang | 40/711 |
| 6,101,753 | A | | 8/2000 | Shieh | |
| 6,189,250 | B1 | * | 2/2001 | Bell | 40/711 |
| 2006/0162215 | A1 | * | 7/2006 | McVay | 40/799 |

OTHER PUBLICATIONS

IKEA, "Finlir" Acrylic Picture Frame, On-Line Catalogue: www.ikea.com.

MUJI, "Acrylic Photo Frame," On-Line Catalogue: http://www.mujionline.com/shop_uk/productpage.asp?PID=465.

* cited by examiner

*Primary Examiner*—James R. Brittain
*Assistant Examiner*—Ruth C. Rodriguez

(57) ABSTRACT

The specification discloses a picture display device comprising a pair of transparent plates interconnected and supported for viewing by a single integral fastener. The fastener is able to integrally engage a variety of optional embellishing elements to be chosen and added by the end user. The frame is of knockdown construction.

21 Claims, 7 Drawing Sheets

SELF SUPPORTING KNOCK-DOWN DISPLAY FRAME DEVICE HAVING A MULTITUDE OF INTERCHANGEABLE PARTS ENGAGED BY AN INTEGRAL FRAME FASTENING AND FRAME SUPPORT DEVICE

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention is related to picture frame display devices, specifically to an improved knock down frame that is capable of engaging a multitude of interchangeable elements on an integral supporting device.

2. Background of the Invention

The design of picture frames has dealt in large part with a picture frame's two necessary functions: (1) to hold a photo for viewing and (2) to integrate into the frame, some mechanism which allows the frame to stand upright, or be mounted to a surface to facilitate such viewing.

In a picture frame where a picture is held behind a transparent surface, most frames utilize a structural border element. U.S. Pat. No. 6,101,753 to Shieh (2000) although not unique in this manner, is sufficient to illustrate the basic disadvantages of such designs. The structural integrity of this kind of picture frame is provided by a structural border which acts as a continuous perimeter frame for the transparent surface. Such designs by their nature, consist of a large number of parts and require the addition of a separate mechanism which must hold the picture within the frame and against the back of the transparent surface, and another separate mechanism by which the frame is mounted to a wall, or set stably upright on a table. Such designs, although ubiquitous in shops and stores around the country, are by nature of their flawed complexity and the labor intensity of their fabrication, expensive to produce. Such frames are rendered inoperable when the frames fall apart at the corners. Where such corner devices are provided to strengthen the frames at the corners, such parts are numerous, expensive, and are simply a temporary fix to an old problem.

Prior art has allowed the typical picture frame, described above, to be reduced in complexity by removing the necessity for a structural border. U.S. Pat. No. 4,310,976 to Wilton (1982) is one such example of a frame where both the structural frame border and the matting have been removed to reduce complexity and cost. The disadvantage of this invention can be seen in the number of parts required and the superfluous nature of its support element. This frame requires numerous threaded fasteners to hold the picture between two transparent sheets, and the multiple fasteners add unnecessary cost and unneeded complexity to the design. Although the design requires this structural redundancy in order to function, it gains no additional utility or value as a result. In addition, the frame continues to be subject to the problem that it requires the addition of a separate and superfluous mechanism to properly support the frame for viewing.

The advantages of integrating a support device into the frame itself has been explored in prior art. The potential advantages of utilizing a support element in such a way that it also serves as the mechanism by which the frame members sandwich a photograph, are illustrated by Korzon (1978) U.S. Pat. No. 4,091,555. However, the frame suffers from the detrimental complexity of its design. Although claiming to be of knock-down construction, the frame appears difficult to assemble. The support element consists of three parts which must be attached at 4 separate holes which are drilled through both layers of clear plastic which sandwich the photograph. The manufacturing process which produces a frame of this complexity is certainly more expensive and time consuming than one used to produce simpler designs. Korzon's own words describe the "plurality of rods" and the "plurality of ports" to engage the rods. Such a description reveals a flawed complexity which results in a frame and an assembly procedure that is more complicated than necessary.

Prior art has attempted to solve the issues of unnecessary complexity and the use of numerous superfluous parts, illustrated in the examples above. U.S. Pat. No. 2,409,814 to Vargish (1946) is an example of such a frame which reduces the picture frame to a single homogenous element. It consists of a single length of transparent material made from a single length of transparent sheet material folded to form a front panel, a back panel, and a foot portion to support the frame. The benefits of such a frame are obvious for cost and ease of use, but the frame has been simplified deleteriously. The frame's quality suffers because of the market's understanding of its cheapness of cost combined with the simplicity of construction. When a frame such as this is purchased, or given as a gift, it is understood that the cheapness and simplicity relegates it to that of a disposable item. In addition, the lack of variability of the design does not allow changes to the frame except the photo that it contains. Although the frame may be manufactured in various colors, and etchings on the plastic could be used, the frame itself has no parts (integral or otherwise) which may enhance its utility.

Slightly more complex prior art suggests a possible benefit from added features which, although adding additional components, may increase the value and enhance the utility of a frame device. U.S. Pat. No. 2,486,174 to Kissling (1949) integrates a supporting device of a particular helical shape made from a single piece of material. However, because the frame is of a unique aesthetic design, it illustrates a major disadvantage: the unique fixed character of a frame limits its marketability. What the frame gains from the unique shape of its support member, it loses as a result of the limited and fixed nature of the visual effect provided.

Most picture frames suffer from either unnecessary complexity, deleterious oversimplification, limited usefulness due to the fixed nature of their designs, or a combination of these problems. In the case of U.S. Pat. No. 560,465 to Bostwick (1896), there is revealed yet another problem. Although Bostwick overcame the problem of limited marketability by incorporating an element of interchangeability into a picture frame support device, the support element and its variable ornament is not an integral part of the frame in such a way that the frame and the support member are fixed together in a manner that ensures their inseparability. If the support leg in Bostwick's design separates from the frame (a likelihood so great as to be inevitable) the frame is rendered useless. The problem with this design, and many others, is that the frame contains necessary, independent elements without which the frame is unable to function as intended. And in the specific case of Bostwick, the problem is inflamed by the fact that the element of interchangeability is precisely that element which is independent of the frame itself.

Prior non-patented art has modified U.S. Pat. No. 4,310,976 to Wilton (1982) by integrating into the two bottom fasteners, a means by which the frame is supported for viewing. This is accomplished by the use of an elongated support member extending rearward, which also acts as the fastening element for the bottom of the frame. In this manner, a design manufactured for the Muji company (a subsidiary of Ryohin Keikaku Europe, 5th Floor 167-169 Great Portland Street, London, UK) and another manufactured for Ikea both solve the problem of the use of superfluous mechanisms in display frame design. Although this integral support mechanism is an advantage over Wilton (1982) the designs of both the Muji frame and the Ikea frame erroneously include the disadvantages inherent in Wilton (1982), the shortcomings apparent in Vargish (1946) and the problems evident in Kissling (1949). For the sake of simplification, because the frames are identical, I will refer to only the Ikea frame in the following arguments. It should be understood however that any discussion of the Ikea frame is also entirely applicable to the Muji frame.

Similar to Wilton (1982) the Ikea frame includes a number of redundant elements which are necessary for the frame to function, but which do not add value or utility to the frame. The Ikea frame has two plates of plastic with one hole in each corner of each plate, for a total of eight holes. Each hole requires a two part threaded fastener, for a total of eight individual threaded fasteners. Thus, there are a large quantity of elements required for the frame to properly function, and also multiple processes required to manufacture the plastic frame so that it is able to engage all the necessary fasteners. These required manufacturing processes and elements add unnecessary cost and unneeded complexity to the design, and the frame gains no enhanced value or utility as a result.

In addition, similarly to Wilton (1982) the frame is limited to including only substantially two dimensional photographs. Any objects thicker than a standard photograph will cause bowing of the plastic sheets. Although this bowing can be accommodated by flexible materials like acrylic or other similar plastics, the resulting curvature compromises the integrity of the frame and of the art object or photograph within. The curvature will cause varied and distracting light to reflect off the uneven front surface which is intended to remain flat. This light reflection is distracting and it will make the proper viewing of the photograph difficult. Thus, since the sole function of this frame is to display a photograph for viewing, the aforementioned limitations compromise the frames intended function.

Similar to Vargish (1946) the Ikea frame has been oversimplified deleteriously. The only embellishment available to this frame is the photograph it contains. There is no other proscribed method for enhancing the frame itself in a simple way. The fixed nature of its design, although different from Kissling (1949), is limiting in terms of the visual effect provided. Its value is therefore diminished in proportion to the inability of the frame to be customized in a manner which may enhance its value and usefulness.

Another disadvantage of the Ikea frame is that a number of parts (in this case, fasteners) must be completely removed from the frame in order for the photograph to be inserted or removed. The removal of these numerous fasteners carries with it the possibility that one of these elements will be lost or misplaced during the regular process of changing the photograph. If the intention of the frame is to be a simple device of knockdown construction and to allow a photograph to be repeatedly inserted or removed, then this design affects this function negatively. Since the sole function of the frame is to display a photograph the potential loss of necessary elements is a major disadvantage.

As is evidenced by the range of information presented above, all picture frames heretofore known suffer from a number of disadvantages:

(a) Picture frames have superfluous elements for support or mounting of the frame for viewing. Such elements add unnecessary complexity and add cost to the design.

(b) Picture frames contain elements of their construction that are not integrally fastened and could be lost, misplaced, or damaged during regular handling, or during the process of inserting, removing or replacing a photograph.

(c) Picture frames utilize a continuous perimeter frame which has structurally connected corners, fastened in such a way that they may become damaged, rendering the frame inoperable.

(d) The continuous perimeter frame requires a large number of unique parts to mate the perimeter frame to the other pieces of the assembly: (1) a transparent surface, (2) matting, (3) a backing element to hold the matting and the photo against the transparent surface (which must be removed periodically to gain access to the photo), and (4) a mechanism by which the whole frame assembly supports itself for viewing.

(e) In general, picture frames have a large number of parts, making them expensive to produce and difficult to assemble.

(f) Most picture frames lack the novelty of being of knock-down construction, wherein they are intended to be assembled by the end user.

(g) Even in situations where the picture frames are intended to be assembled by the end user, the ease of such assembly is stymied by the flawed complexity of the frame's design.

(h) Picture frames have been oversimplified deleteriously; to the point that there is little ability to customize the frame except by replacing the picture within.

(i) Picture frames have been designed in a such a way that their fixed forms have limited aesthetic value, and there is no proscribed method for enhancing the frame itself in a simple way.

(j) Picture frames made of plastic or other similar materials become bowed by the photographs placed between the layers of the assembly, making it difficult to view the photograph because of distracting light reflections off the uneven surface.

DEFINITIONS

Unless otherwise defined, all technical and scientific terms used herein have the same meaning as commonly understood by one of ordinary skill in the art to which this invention belongs. Although methods and materials similar or equivalent to those described herein can be used in the practice or testing of the invention, suitable methods and materials are described below. All publications, patent applications, patents, and other references mentioned herein are incorporated by reference in their entirety. In the case of conflict, the present specification, including definitions, will control. In addition, the materials, methods, and examples are illustrative only and not intended to be limiting.

Plate as used herein refers to any object with a substantially flat surface, of any shape or size, and of any material. In the case that two plates are used together on a horizontal surface, one of the plate needs to be of a rigidity which makes it capable of supporting itself at a predetermined angle. In this case, the second plate may be flexible, to the point that it is not self-supporting, so long as it is proximally secured to the other plate for support by the integral support member.

Support member or support leg as used herein refer to any elongated element having a predetermined cross section and a predetermined rigidity which makes it capable of bearing a predetermined weight both at various angles to, perpendicular to, and parallel to its long axis.

Embellishing element or optional embellishment as used herein refers to any two or three dimensional object capable of engaging the support member. This element may be attached to the support member in any way. In the preferred embodiment the embellishing element has a formed or drilled hole through which the support member is placed. This element may also be attached to the support member in any way as would be obvious to one of ordinary skill in the art. For example it may be mechanically fastened by threads to the end of the support member.

Fastener or fastening device as used herein refers to any device capable of engaging or otherwise attaching to the support member in a manner such that it can be loosened or removed and then reattached. For example the support member may be a threaded bolt, and the fastening device may be a threaded wing-nut or other kind of nut which threads onto this bolt.

Art object as used herein shall refer to any two or three dimensional object intended to be displayed for viewing.

Picture or photograph as used herein refers to a variant of the art object, as any substantially two dimensional image. The thickness of a particular piece of two dimensional artwork my vary considerably, and so herein, the term picture or the term photograph shall not be limited only to substantially flat objects or images.

OBJECTS AND ADVANTAGES

The objectives of this new display frame device are to integrate into a picture frame a support member and a fastener which act to perform, simultaneously, both of the two primary functions of a picture frame as stated above: (1) to hold a photo for viewing and (2) to integrate into the frame a device which allows the frame to stand upright on a horizontal surface. In addition the display device utilizes the same support member and fastener to incorporate a multitude of optional interchangeable embellishing elements. The support member and the fastener are installed in such a manner that the entire frame device and the optional and interchangeable embellishing elements are held together such that none of parts and pieces can be lost or misplaced without being intentionally removed. The display device is constructed in such a way that the photograph inside can be easily inserted and removed by loosening the fastener, and the pieces need not be separated completely to allow the picture to be removed and/or replaced. Accordingly, besides the objects and advantages of the display device described above, several objects and advantages of the my display frame device are:

(a) To provide a display device where no matting is required. The size of the display device corresponds to the size of the standard photos available in the market. This ensures that the picture may easily be placed accurately within the display device by aligning with at least one edge of the frame.

(b) To provide a display device which is constructed in such a way that a picture can be easily inserted and removed; and all the display device's parts remain integrally connected at all times as the picture is inserted or removed.

(c) To provide a display device which is easy to assemble without the use of any tools, in a foolproof manner that is fun and easy to perform.

(d) To provide a display device which is of knock-down construction, so that it can be shipped flat and then put together by the end user.

(e) To provide a display device which allows for an extensive variety of materials to be utilized: transparent, opaque, or otherwise. For example the plates may be made of plastic, glass, aluminum, steel, wood of any color, carbon fiber, or nearly any other material. It can be readily manufactured in various sizes and in a wide variety of shapes and materials. In this manner, the display device itself becomes a kit with a multitude of interchangeable parts. All of the possible configurations of the display device benefit from the overall simplicity of construction and ease of use.

(f) To provide a display device which has integral parts to enhance its usefulness. These optional embellishments may be any type of 2-dimensional or 3-dimensional parts. These parts are added to the location of the support leg at any layer of the display device's construction to provide an integral and interchangeable element to increase marketability and options for the buyer. These parts may be rigid or flexible to provide the desired visual effect. These parts may be made of a variety of materials, in various sizes, thicknesses, and shapes. These parts allow the display device to be customized by the end user according to their tastes.

(g) To provide a display device in which the optional embellishments are fastened in such a way that they cannot be lost or misplaced, without being intentionally removed by the user. During the course of the method of changing the photograph or art object, these embellishments remain integrally fastened to the frame device.

(h) To provide a display device in which single or multiple photographs may be placed at odd angles and in sizes (larger or smaller) in such a manner as may not be outlined in this patent.

(i) To provide a display device for the display of a photo in both the vertical and horizontal formats (portrait or landscape) without any reconfiguration or rotation of the display device. The display device is sized in such a way that the display orientation of the photo is easily made within the structure of the frame.

(j) To provide a display device to display photographs or art objects of varying thickness by providing optional pieces of material (clear or otherwise) of varying thickness between the plates at the point of the fastener. This assures that the plates are propped apart a sufficient distance to allow the thickness of the photograph(s) or art object(s) to be placed within, without the plates bowing or bending.

(k) To provide a display device which may be reduced to simply one layer which is supported at the proper angle by the integral support member.

(l) To provide a way by which the embellishing element may act simultaneously as the front fastener. In this way, the embellishing element has a dual function of decoration and front fastening device and acts in concert with the rear fastener to sandwich the layers of the assembly.

(m) To provide a display device with a support member which may be easily extended or replaced with a member of a longer or shorter length. This change in length of the support member allows the display angle of the frame to be customized. This change in length also allows the number or thickness of the layers of the assembly to be easily increased or decreased while at the same time, maintaining a long enough or short enough support member to hold the layers and also support the display device in the proper position for viewing.

Further objects and advantages are to provide a display device which is simple in construction and low in material cost and production cost. The display device is of a very high quality which can be custom tailored to end users' desires by the addition of optional integral embellishing elements. The optional embellishments are made in a variety of materials, in a variety of sizes, shapes, and colors, to best suit the end user's tastes. Still further objects and advantages of the present display frame device will become more fully apparent with reference to the following specification and drawings which relate to a preferred embodiment of the present display frame device.

SUMMARY OF THE INVENTION

In accordance with the present invention, a display device comprises two plates of substantially rigid material, at least one optional embellishing element, and an integral support member which maintains the assembled display device in a vertical or near vertical position for viewing; and at the same time provides a fastener device for sandwiching various materials, elements, photographs, or objects in between, in front of, or behind the various layers of the assembly in such a manner as all the elements remain integrally fastened as a photograph or other artwork is inserted or removed.

DRAWINGS

Figures

DRAWINGS

Reference Numerals

| | | | |
|---|---|---|---|
| 12 | front fastener | 14 | embellishing element |
| 15 | hole in embellishing element | 16 | front plate |
| 17 | hole in front plate | 18A | photograph in vertical format |
| 18B | photograph in horizontal format | 20 | back plate |

-continued

| | | | |
|---|---|---|---|
| 21 | hole in back plate | 22 | rear fastener |
| 24 | support leg | 26 | plastic cap |
| 28 | spacer | 29 | hole in spacer |
| 30 | leaf | | |

DETAILED DESCRIPTION OF THE DRAWINGS

Figure 1:
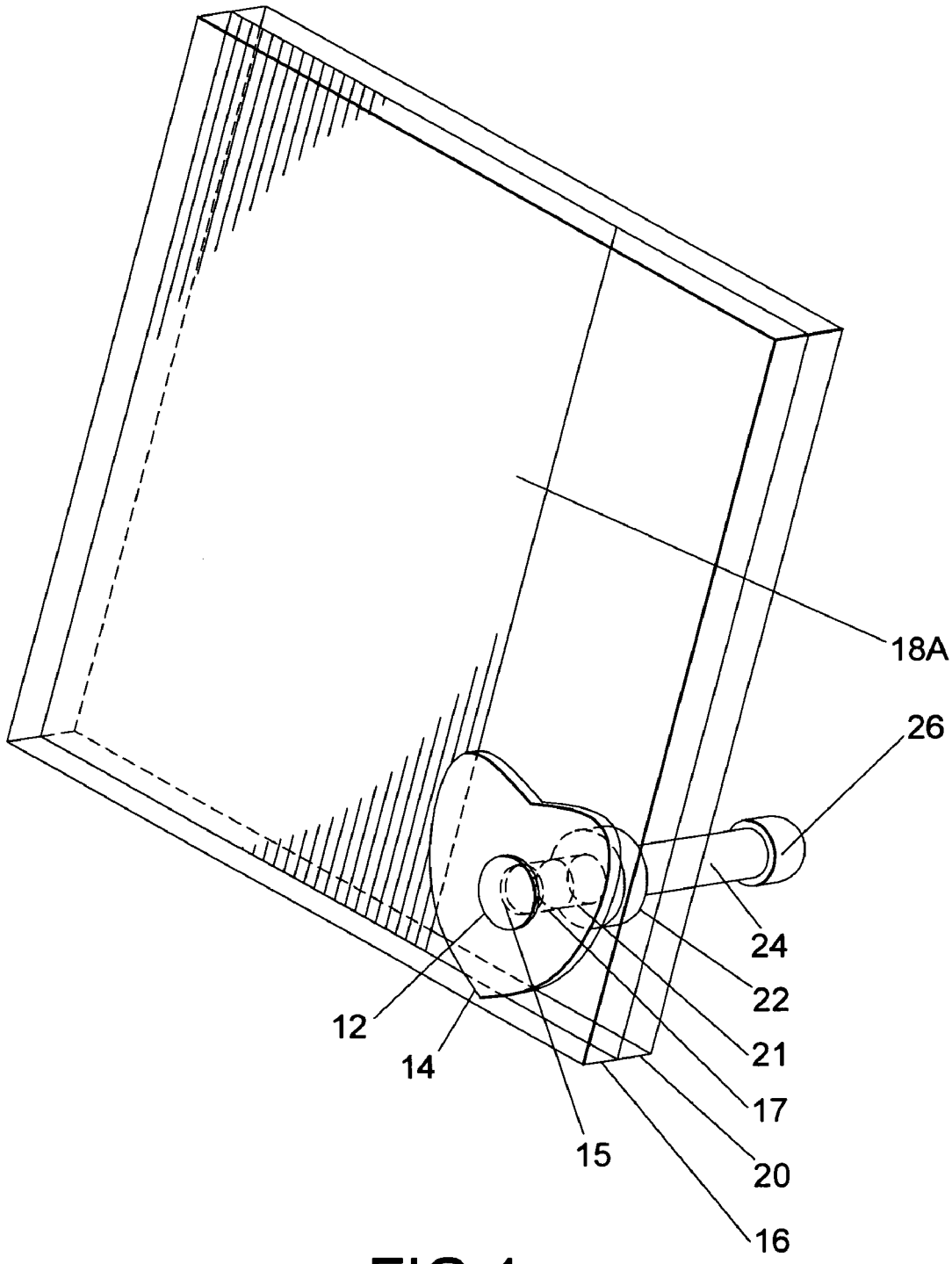
FIG. 1 shows an isometric view of the assembled display frame device.

A Preferred embodiment of the assembly of the present display frame device is illustrated in FIG. 1, an isometric view. The illustration indicates two clear obverse plates 16 and 20 of clear acrylic resin or other similar and suitable material which are sandwiching a photograph or other art work illustration 18A. The photograph 18A is retained between the backward facing surface of the obverse plate 16 and the frontward facing surface of the obverse plate 20. The manner in which the assembly is held together is best seen in FIG. 2, an exploded perspective view.

Figure 2:
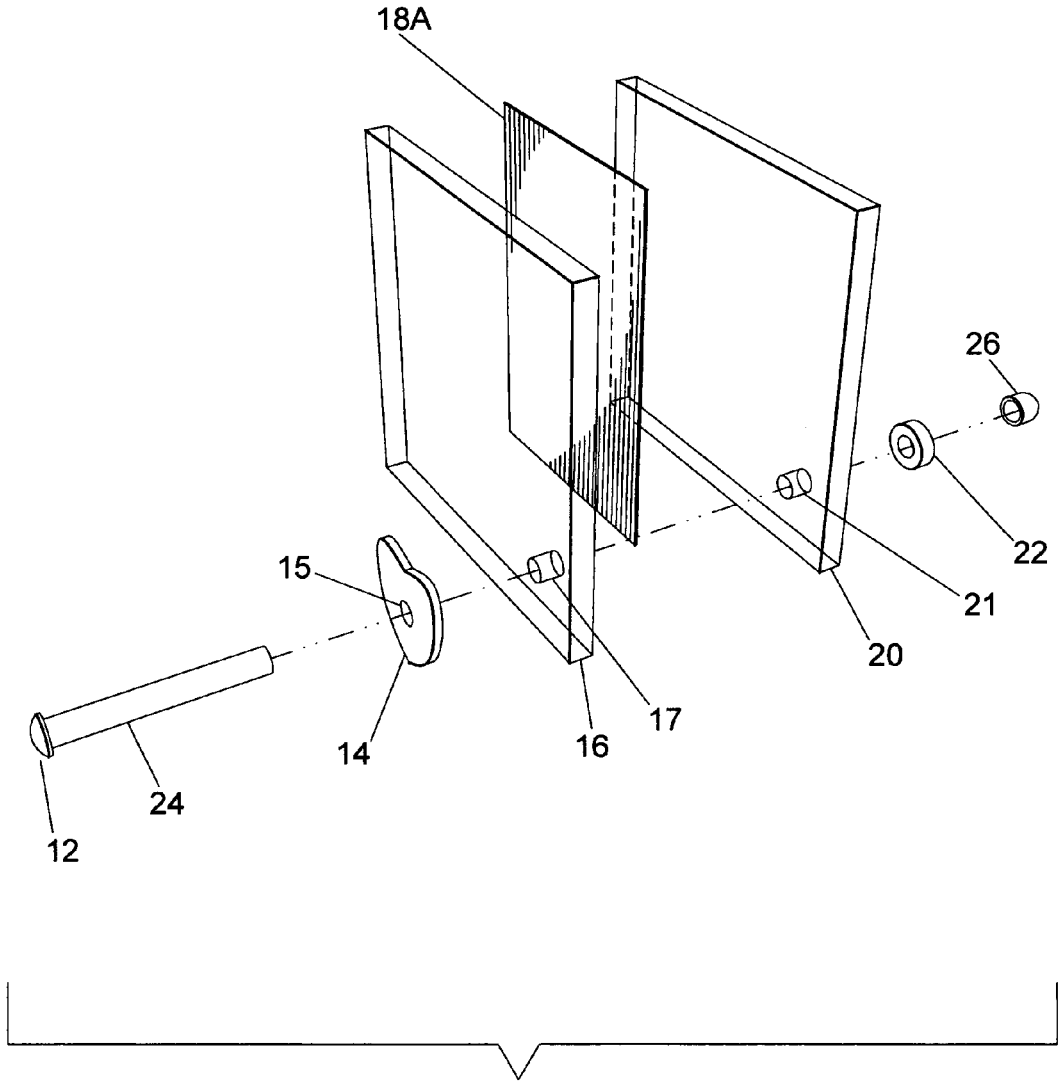
FIG. 2 shows an exploded perspective view of the display frame device embodying the display frame device.

In FIG. 2, an exploded perspective view, shows formed or drilled holes 17 and 21 in the lower right corners of the square or polygonal plates 16 and 20. These holes 17 and 21 are in respective registry between the two plates and extend normal to the obverse surface of the plates 16 and 20 and extend completely through both of the plates.

Figure 8A:
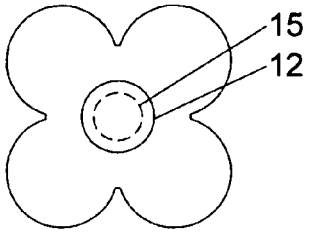
FIGS. 8A through 8X show front plan views of optional embellishing elements.
Figure 8B:
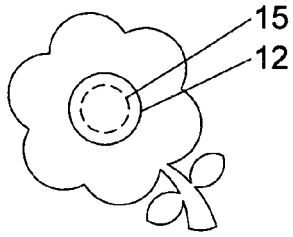
Figure 8C:
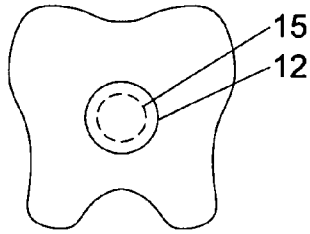
Figure 8D:
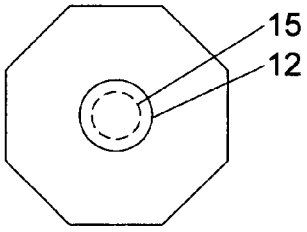
Figure 8E:
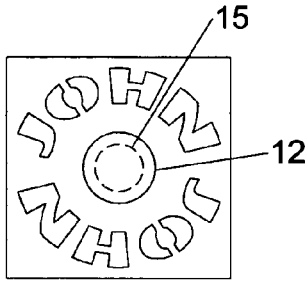
Figure 8F:
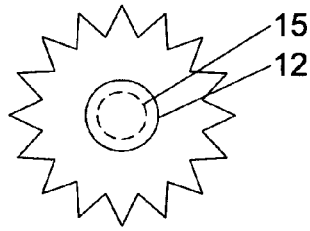
Figure 8G:
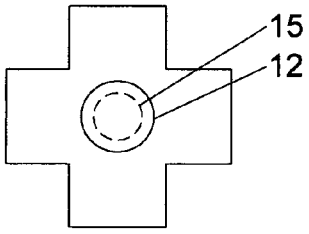
Figure 8H:
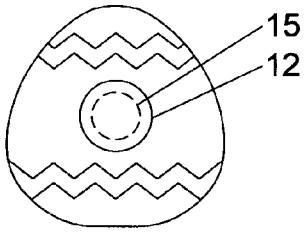
Figure 8I:
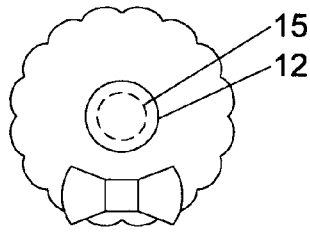
Figure 8J:
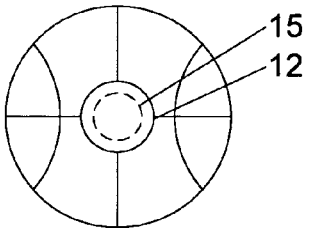
Figure 8K:
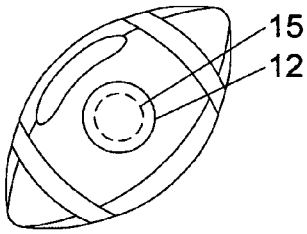
Figure 8L:
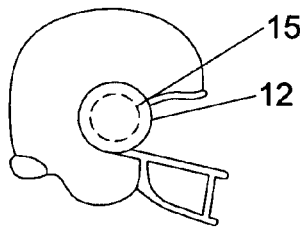
Figure 8M:
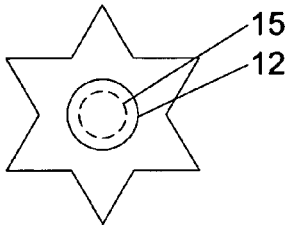
Figure 8N:
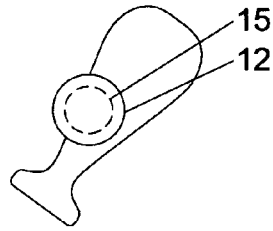
Figure 8O:
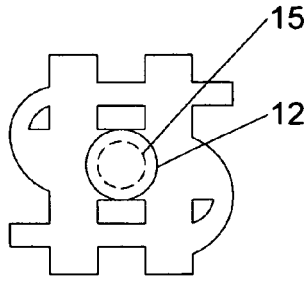
Figure 8P:
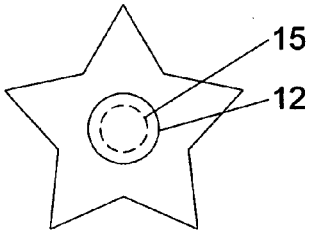
Figure 8Q:
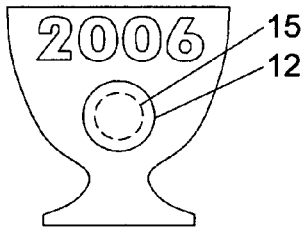
Figure 8R:
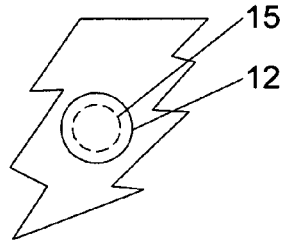
Figure 8S:
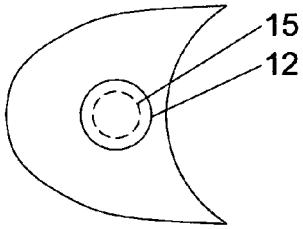
Figure 8T:
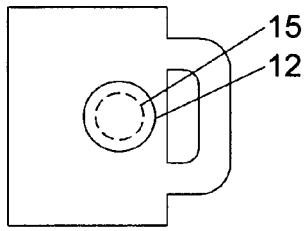
Figure 8U:
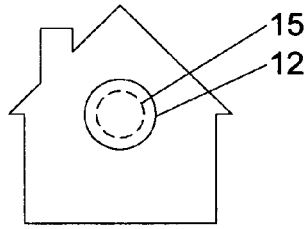
Figure 8V:
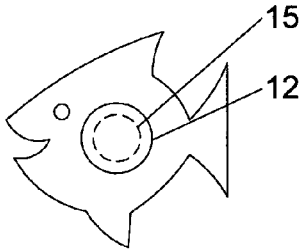
Figure 8W:
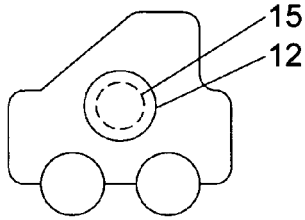
Figure 8X:
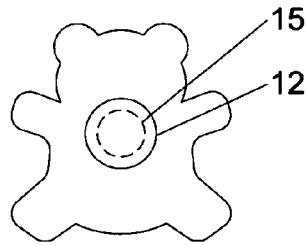

As shown in both FIGS. 1 and 2, the already unique assembly is embellished with an optional heart-shaped FIG. 14 with a formed or drilled hole 15 which is in respective registry with the drilled holes 17 and 21 in the plates. This heart-shaped FIG. 14 is just one of a multitude of embellishments that can be placed at any point on the support leg 24 between the front fastener 12 and the back fastener 22. For a visual list of other optional embellishments, FIGS. 8A through 8X clearly indicate a number of options. These optional embellishments are intended to replace the heart-shaped FIG. 14 in its engaged position on the support leg 24. This list of optional embellishments in FIGS. 8A through 8X is not meant to be an exhaustive list, but simply an illustration of the multitude of creative embellishments which are intended to be offered as optional additions to the assembly. The optional embellishments in FIGS. 8A through 8X are available in a variety of different materials, colors, sizes, and thicknesses. Embellishments of the type shown, even if not illustrated herein, are fully intended to be covered under the scope of the present invention and omissions shall not limit this scope.

As shown in FIG. 2, the assembly is provided with a one position stand device which is comprised of a front fastener 12, a support leg 24, a back fastener 22, and an optional protective cap 26. The protective cap 26 is designed to protect tables or other such horizontal surfaces from any abrasion by the support leg 24. In the preferred embodiment, the front fastener 12 and the support leg 24 are permanently attached; however, this is not necessary. And one can immediately see a potential advantage if the front fastener is mechanically attached to the support leg by a threaded device or other similar type of device by which it can be easily removed and replaced.

The front fastener 12 may be comprised of any desired ornament; cut, stamped, painted or attached in any desired manner to the front of the support leg 24 for the purpose of ornament or to carry an advertisement. Such a system would allow the front fastener 12 to act as an additional or alternate integral embellishment. In this manner, the FIGS. 8A through 8X should also be considered without the front fastener 12, such that they perform the dual function of front fastener 12 and embellishment 8A through 8X. In this manner, any of the optional embellishments FIGS. 8A through 8X may replace the front fastener 12 and perform its function. Instead of being sandwiched between the front fastener 12 and the rear fastener 22, the optional embellishment 8A through 8X may act to sandwich the other layers of the frame between the back side of the optional embellishment and the front side of the rear fastener 22.

In the preferred embodiment shown in FIG. 2 the front fastener is attached to the forward facing end of the support leg 24 which is inserted through the registered holes 15, 17, and 21, until the back side of the front fastener 12 rests upon the front side of the heart-shaped FIG. 14. The frame may be assembled without this heart-shaped figure, in which case the back side of the front fastener 12 would rest against the front side of the front plate 16. The support leg is fully inserted through the layers of the assembly (in FIG. 2 of the preferred embodiment these layers consist of the following: the heart-shaped FIG. 14, the front plate 16, and the back plate 20) in such a manner as the photograph 18A is sandwiched between the plates. The back fastener 22 is attached to the support leg in such a manner as to sandwich all of the layers of the assembly, including the photograph, securely between the front fastener 12 and the back fastener 22.

Figure 3:
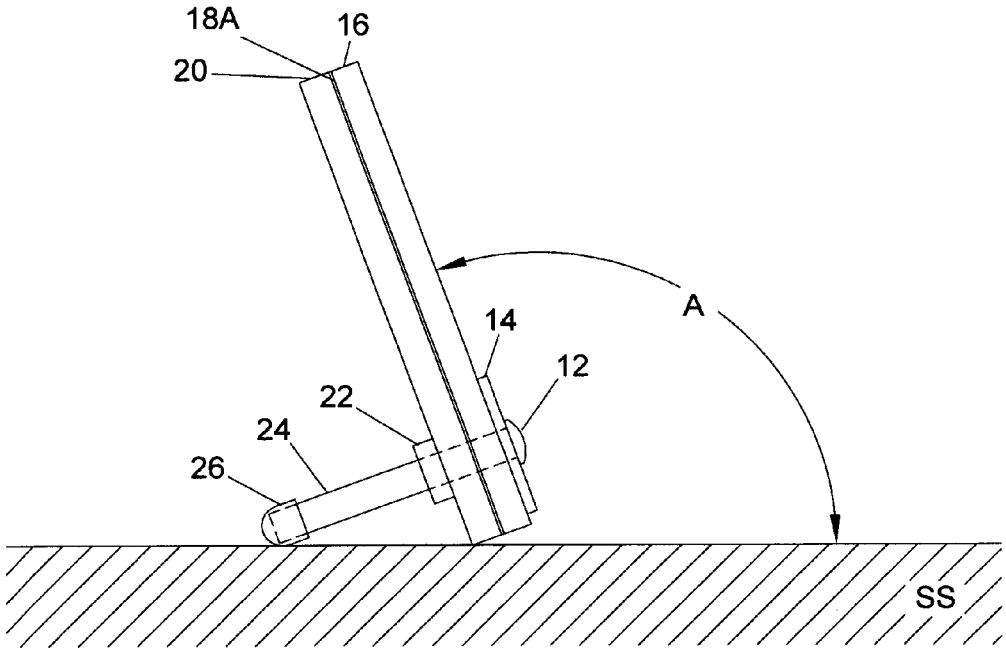
FIG. 3 shows a side elevation view of the display frame device.

As illustrated in FIG. 3, the angle A of display between the obverse face of the obverse plate 16 and a supporting surface SS is maintained by the length which the support leg 24 extends rearward and the location of the holes 17 and 21 in the front and back plates.

Figure 4:
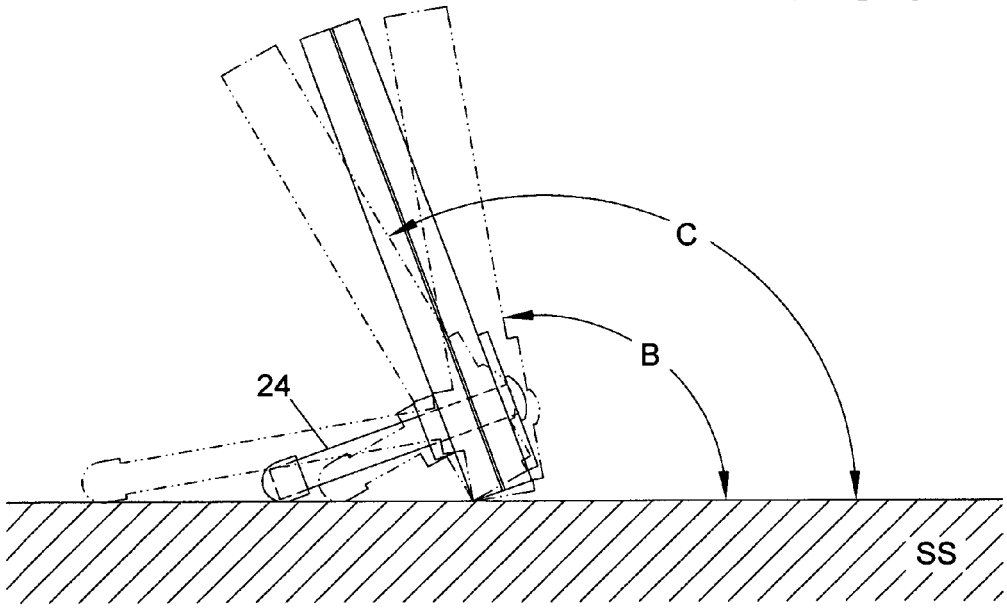
FIG. 4 shows a side elevation view of the display frame device indicating possible angle adjustments

In order to provide a steeper (smaller) display angle B as shown in FIG. 4, the length of the support leg 24 is increased. In order to provide a shallower (larger) display angle C as shown in FIG. 4, the length of the support leg is decreased. The adjustable length of the support leg 24 also serves to accommodate a variety of material thicknesses or quantity of materials. The display angle is only limited in the smaller direction B by reaching the vertical position in which forward overturning will occur. The display angle is only limited in the larger direction C by rearward overturning which is related to the height and weight of the materials utilized. Additional structural elements attached to the rearward end of the support leg 24, or a change in the shape of the support leg 24 are also optional ways to further stabilize the frame assembly.

In order to change the picture or other art object 18A or 18B, one need merely loosen the rear fastener 22 a sufficient distance to remove the picture. Then another photograph or art object 18A or 18B is placed between the obverse plate 16 and the backing plate 20 and, if desired, aligned with 2 or more edges of the plates. Then the plates 16 and 20 are aligned and the rear fastener 22 is tightened once again, securing all the layers of the assembly.

Figure 5:
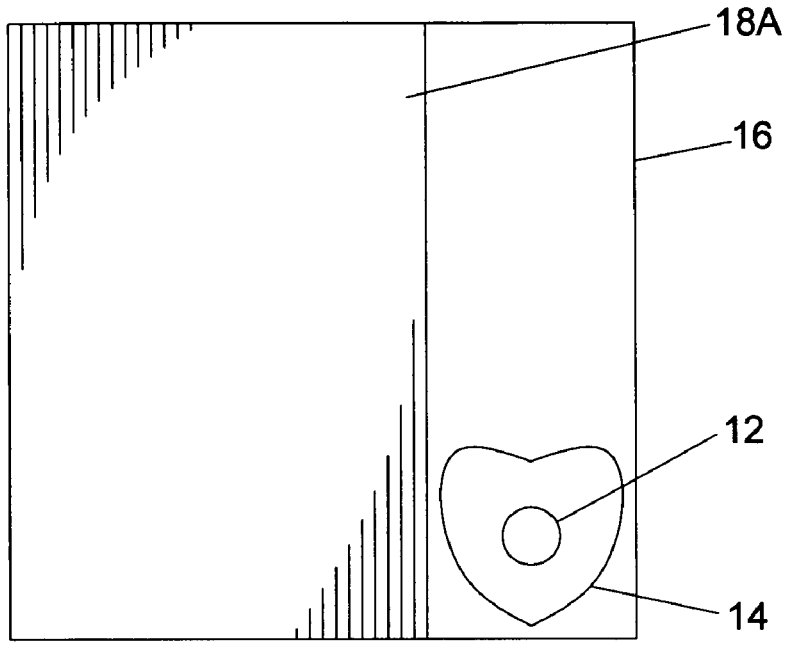
FIG. 5 shows a front plan view of the display frame device with a photograph inserted in the vertical (portrait) format.
Figure 6:
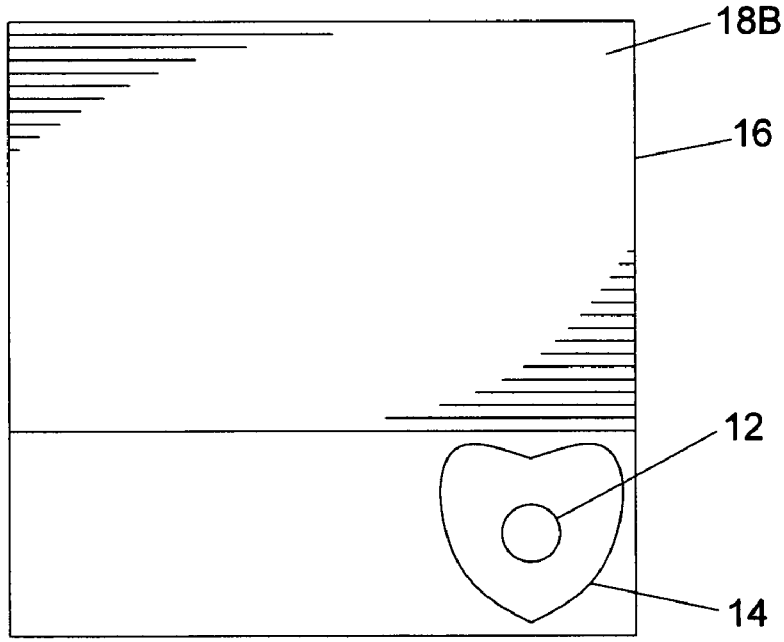
FIG. 6 shows a front plan view of the display frame device with a photograph inserted in the horizontal (landscape) format.

FIG. 5 and FIG. 6 clearly illustrate the ability of the frame to incorporate a photograph in the vertical position 18A (portrait) or the horizontal position 18B (landscape). The frame is designed in such a way as to accommodate a standard sized photograph in either the portrait or landscape format without requiring reorientation of the frame itself. In addition, the photograph may be properly placed by aligning with one or more edges of the frame in either orientation.

Figure 7:
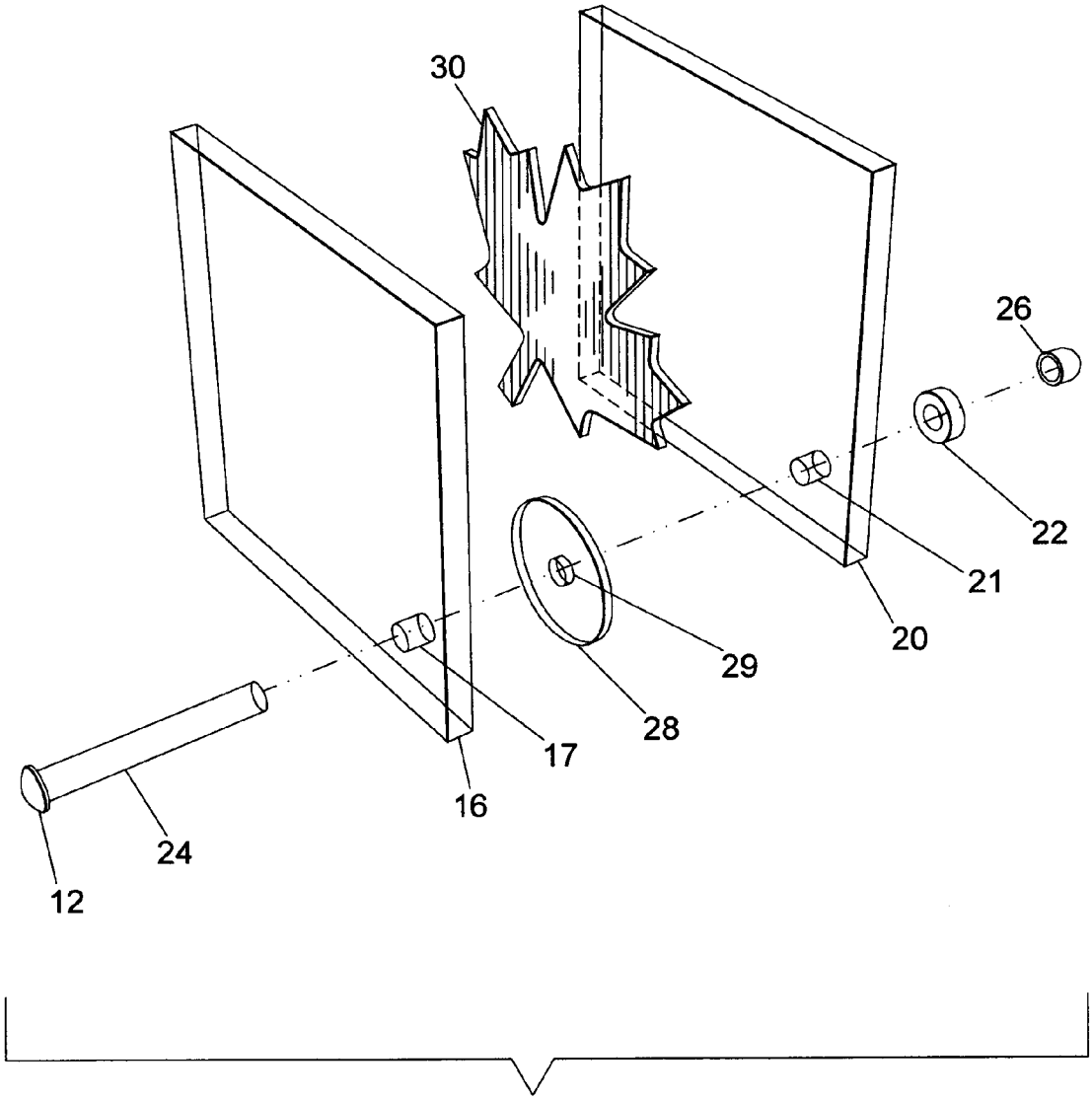
FIG. 7 shows an exploded perspective view of the display frame device with an optional spacer element.

FIG. 7 shows an additional embodiment for the display frame device wherein a spacer 28 with a formed or drilled hole 29, in respective registry with the drilled holes 17 and 21 in the plates, is placed between the front plate 16 and the back plate 20. This spacer 28 will be used when an object of a predetermined thickness (a thickness greater than a standard photograph) is to be placed between the plates 16 and 20 for display. Such an art object might be a leaf 30, which is of a thickness that does not allow substantially continuous contact between the front plate 16 and the back plate 20. In order that the front fastener 12 and the back fastener 22 engage the layers of the assembly without bowing, due to the resistance in thickness of the leaf 30, the plates will be propped apart by the spacer 28. The disadvantage of a frame without such a spacer can be seen in the previously referenced U.S. Pat. No. 4,310,976 to Wilton (1982). The curvature of the front and back surfaces, resulting from the thickness of the objects sandwiched inside will inevitably cause nonuniform and distracting light reflections off of the uneven viewing surface. In my display frame device, the spacer 28 resolves this problem simply and effectively. An additional embodiment of FIG. 7 may also include an optional embellishment of the type illustrated in FIGS. 8A through 8X.

As can be seen from the foregoing specification and drawings, this display frame device provides a new and novel picture frame device which is knockdown and self-supporting. It is constructed of a minimum number of parts and may be assembled in a fool proof manner. The frame may be modified by a multitude of embellishing elements which can be readily changed. Furthermore, the display frame offers an easy way to change the photograph or other contents within while all the elements of the frame remain integrally attached. The display frame device may also provide a device by which the plates 16 and 20 may be propped apart so that variable thickness of the contents sandwiched within is easily accommodated.

CONCLUSION, RAMIFICATIONS, AND SCOPE

Accordingly, the reader will see that the display frame device of this invention can be easily assembled, in a foolproof manner, from a minimal number of parts. In addition it can be easily and conveniently customized by an end user or a retailer, by way adding any of a wide variety of possible embellishing elements which enhance its value and utility. Furthermore all the parts of the assembly are integrally fastened in such a way that a photograph can be simply and easily inserted or removed without completely removing any part of the assembly, thus ensuring that no parts of the display frame device will be lost or misplaced during this process. Furthermore the display frame device has the additional advantages in that

- the size of the display device corresponds to the size of the standard photos available in the market, thus ensuring that the picture may easily be placed accurately within the display device by aligning with at least one edge of the frame;
- it can be readily manufactured in various sizes and in a wide variety of shapes and materials, such as plastic, glass, aluminum, steel, wood of any color, carbon fiber, or nearly any other material;
- it allows single or multiple photographs to be placed at odd angles and in a variety of sizes;
- it allows a photograph to be displayed in both the vertical and horizontal formats (portrait or landscape) without any reconfiguration or rotation of the display device;
- it allows the display of photographs or art objects of varying thickness by providing a spacer between the plates at the point of the fastener, thus assuring that the plates are propped apart so that there will be no bending or bowing of the plates;

it allows the support member to be easily extended or replaced with a member of a longer or shorter length to allow the display angle of the frame to be adjusted, or to accommodate the thickness of the layers of the assembly while maintaining a long enough or short enough support member to hold the layers as well as to support the display device in the proper position for viewing.

Although the description above contains many specificities, these should not be construed as limiting the scope of the invention but as merely providing illustrations of some of the presently preferred embodiments of this display frame device. For example the plates can have other shapes, such as circular, oval, trapezoidal, triangular, etc.; the support leg can have other shapes; etc.

It should be understood that the display frame device of the present invention may be modified as would occur to one of ordinary skill in the art without departing from the spirit and scope of the present invention. Further, while certain combinations of elements have been described, alternative combinations of the described elements are also envisioned.

Thus the scope of the invention should be determined by the appended claims and their legal equivalents, rather than by the examples given.

The invention claimed is:

1. A display device comprising:

(a) at least one plate comprising a substantially rigid material comprising a frontward surface, a rearward surface, and at least one assembly port situated in said plate;

(b) an elongated support member adapted to be received in said assembly port and comprising a front end and a back end;

(c) at least one decorative ornament comprising a means by which it engages said elongated support member;

(d) at least one fastening element, wherein said means by which said decorative ornament engages said elongated support member is temporary and said decorative ornament is adapted to be selectively removed from said elongated support member; said elongated support member is adapted to be disposed through said assembly port of said plate, is adapted to engage at least one said fastening element thereby to proximally secure said decorative ornament and said plate such that they are immobilized on said elongated support member, and said elongated support member is adapted to extend through said plate and contact a horizontal support surface at a location rearward of said rearward surface of said plate and spaced from a location at which an edge of said plate is in contact with said support surface when said plate is in an upright position thereby to support said plate in said upright position.

2. The display device of claim 1 wherein said elongated support member engages at least one additional plate having a frontward surface, a rearward surface, and at least one assembly port, and said plates are adapted to assume an overlying relationship in an assembled condition for receiving at least one picture therebetween, and at least one of said plates is transparent, and adapted to overlie an image side of a picture for viewing the picture therethrough.

3. The display device of claim 2 wherein said plates, said elongated support member, said decorative ornament, and said fastener are adapted to remain integrally connected at all times even as said fastener is loosened but not removed, to allow said picture or other at object to be inserted or removed.

4. The display device of claim 2 wherein said elongated support member engages a spacer of a predetermined thickness between said plates such that said plates are uniformly propped apart a sufficient distance to allow an object to be sandwiched between said plates without said plates warping or bending under the pressure of said fastener.

5. The display device of claim 1 wherein said elongated support member has a protective cap on said back end.

6. The display device of claim 1 wherein said elongated support member is adapted to be selectively extended, retracted, or replaced with an elongated support member of a longer or shorter length, such that the change in length of said elongated support member allows a display angle of said display device to be adjusted to a predetermined angle on said horizontal surface for viewing while at the same time, maintaining a long enough or short enough elongated support member to proximally secure said plate, said elongated support member, said decorative ornament, and said fastener.

7. The display device of claim 6 wherein said elongated support member, adapted to be selectively extended or retracted, is adjustable.

8. The display device of claim 1 wherein said elongated support member is also adapted to be affixed onto or into a wall or other vertical surface to hang the display device on said wall or other vertical surface.

9. The display device of claim 1 wherein said decorative ornament is selectively removable from said front end of said elongated support member by means of threads.

10. The display device of claim 1 wherein said decorative ornament has a decorative form selected from at least one member of the group of decorative forms consisting essentially of animals, plants, flowers, fruits, vegetables, human figures, sports, sports equipment, holiday symbols, holiday decorations, city skylines, architecture, company logos, cars, planes, trains, boats, modes of transportation, alphabetic letters, text, names, numbers, cultural seals, cultural symbols, cultural crests, heraldic emblems, machinery, symbols of money, symbols of finance, mythological figures, religious figures, religious symbols, religious icons, astrological symbols, astronomical symbols, meteorological symbols, meteorological phenomena, musical instruments, clothing, furniture, jewelry, tools, weapons, symbolic gestures, alchemy symbols, imaginary monsters, mythological monsters, games, game components, game symbols, spaceships, science fiction creatures, or any other decorative form having an ornamental function.

11. A display device comprising:

(a) at least one plate comprising a substantially rigid material comprising a frontward surface, a rearward surface, and at least one assembly port situated in said plate;

(b) at least one decorative ornament comprising a frontward surface, a rearward surface, and at least one assembly port situated in said decorative ornament;

(c) an elongated support leg adapted to be received in said assembly port in said decorative ornament, adapted to be received in said assembly port in said plate, and comprising a front end and a back end;

(d) at least one fastening element, wherein said elongated support leg is adapted to engage said decorative ornament by being disposed through said assembly port in said decorative ornament, said elongated support leg is thereby to be disposed through said assembly port in said plate, and is adapted to engage at least one said fastening element thereby to proximally secure said decorative ornament and said plate such that they are immobilized on said elongated support leg; and said elongated support leg is adapted to extend through said plate and contact a horizontal support surface at a location rearward of said rearward surface of said plate and spaced from a location at which an edge of said plate is in contact with said support surface when said plate is in an upright position thereby to support said plate in said upright position.

12. The display device of claim 11 wherein said elongated support leg comprises a horizontal surface-protecting material on said back end.

13. The display device of claim 11 wherein said elongated support leg is adjustable and adapted to be selectively extended, retracted, or replaced with a support leg of a longer or shorter length, such that the change in length of said elongated support leg allows a display angle of said display frame device to be adjusted to a predetermined angle on said horizontal surface for viewing while at the same time, maintaining a long enough or short enough elongated support leg to proximally secure said plate, said elongated support leg, said decorative ornament, and said fastener.

14. The display device of claim 11 wherein said decorative ornament has a decorative form selected from at least one member of the group of decorative forms consisting essentially of animals, plants, flowers, fruits, vegetables, human figures, sports, sports equipment, holiday symbols, holiday decorations, city skylines, architecture, company logos, cars, planes, trains, boats, modes of transportation, alphabetic letters, text, names, numbers, cultural seals, cultural symbols, cultural crests, heraldic emblems, machinery, symbols of money, symbols of finance, mythological figures, religious figures, religious symbols, religious icons, astrological symbols, astronomical symbols, meteorological symbols, meteorological phenomena, musical instruments, clothing, furniture, jewelry, tools, weapons, symbolic gestures, alchemy symbols, imaginary monsters, mythological monsters, games, game components, game symbols, spaceships, science fiction creatures, or any other decorative form having an ornamental function.

15. The display device of claim 11 wherein said elongated support leg engages at least one additional plate having a frontward surface, a rearward surface, and at least one assembly port, and said plates are adapted to assume an overlying relationship in an assembled condition for receiving at least one picture therebetween, and at least one of said plates is transparent, and adapted to overlie an image side of a picture for viewing the picture therethrough.

16. The display device of claim 15 wherein said elongated support leg is adapted to engage a spacer of a predetermined thickness between said plates such that said plates are uniformly propped apart a sufficient distance to allow an object to be sandwiched between said plates without said plates warping or bending under the pressure of said fastener.

17. The display device of claim 15 wherein said plates, said elongated support leg, said decorative ornament, and said fastener remain integrally connected at all times, even as said fastener is loosened but not removed to allow said picture or other art object to be selectively removed.

18. The display device of claim 11 wherein said elongated support leg is adapted to be affixed onto or into a wall or other vertical surface to hang the display device on said wall or other vertical surface.

19. The display device of claim 12 wherein said horizontal surface-protecting material on said back end of said elongated support leg comprises a plastic cap adapted to fit over said back end of said elongated support leg.

20. A display device comprising:

(a) at least two plates of substantially rigid material each having a frontward surface, a rearward surface, and one assembly port;

(b) one elongated support leg adapted to be received in said assembly ports in said plates and having a front end and a back end;

(c) at least one rear fastening element, (d) at least one front fastener having a decorative ornamental function wherein said plates are adapted to assume an overlying relationship in an assembled condition for receiving at least one picture therebetween, and at least one of said plates is transparent, and adapted to overlie an image side of a picture for viewing the picture therethrough; said elongated support leg is adapted to be disposed through said assembly ports in said plates and said front end of said elongated support leg is adapted to engage, by selectively removable means, said front fastener having a decorative ornamental function; said back end of said support leg is adapted to engage at least one said rear fastening element thereby to proximally secure said plates such that they are immobilized on said elongated support leg; and said elongated support leg is adapted to extend through said plates and contact a horizontal support surface at a location rearward of said rearward surfaces of said plates and spaced from a location at which an edge of one of said plates is in contact with said support surface when said plates are in an upright position thereby to support said plates in said upright position.

21. The display device of claim 20 wherein said plates, said elongated support leg, and said fastener remain integrally connected at all times, even as said fastener is loosened but not removed to allow said picture or other art object to be selectively removed; said picture or other art object sandwiched between said plates is exposed by counter-rotation of said plates on said elongated support leg.

* * * * *